US005977045A

United States Patent [19]

Murphy

[11] Patent Number: 5,977,045

[45] Date of Patent: Nov. 2, 1999

[54] DRY CLEANING SYSTEM USING DENSIFIED CARBON DIOXIDE AND A SURFACTANT ADJUNCT

[75] Inventor: Dennis Stephen Murphy, Leonia, N.J.

[73] Assignee: Lever Brothers Company, New York, N.Y.

[21] Appl. No.: 09/072,773

[22] Filed: May 6, 1998

[51] Int. Cl.[6] ..... C11D 1/82; C11D 3/39; C11D 3/43

[52] U.S. Cl. ..... 510/289; 510/285; 510/286; 510/466; 8/142

[58] Field of Search ..... 510/285, 289, 510/286, 466; 8/142

[56] References Cited

U.S. PATENT DOCUMENTS

| | | | |
|---|---|---|---|
| 4,150,048 | 4/1979 | Schilling, Jr. et al. | 260/448.2 |
| 5,158,704 | 10/1992 | Fulton et al. | 252/309 |
| 5,267,455 | 12/1993 | Dewees et al. | 68/5 |
| 5,676,705 | 10/1997 | Jureller et al. | 8/142 |
| 5,683,473 | 11/1997 | Jureller et al. | 510/286 |
| 5,683,977 | 11/1997 | Jureller et al. | 510/286 |

FOREIGN PATENT DOCUMENTS 08052297 2/1996 Japan .

OTHER PUBLICATIONS

Grant, D.J. W. et al., "Solubility Behavior of Organic Compounds". Techniques of Chemistry Series, J. Wiley & Sons, NY (1990), pp. 46–55.

*Primary Examiner*—Yogendra Gupta
*Assistant Examiner*—Gregory R. Delcotto

[57] ABSTRACT

A system for dry cleaning soils from fabrics is described which contains densified carbon dioxide combined with a selected surfactant. The densified carbon dioxide is used in a temperature range of about −78.5° C. to about 100° C. and a pressure range of about 14.7 psi to about 10,000 psi. The surfactant is selected from one of two groups of compounds having a formula as described in the text or a second group of siloxane compounds having a formula $[AB]_y$ as described. A process for using the dry cleaning system is also described.

5 Claims, 1 Drawing Sheet

DRY CLEANING SYSTEM USING DENSIFIED CARBON DIOXIDE AND A SURFACTANT ADJUNCT

FIELD OF THE INVENTION

This invention pertains to a dry cleaning system utilizing densified carbon dioxide and a particular surfactant adjunct.

BACKGROUND OF THE INVENTION

Densified carbon dioxide provides a nontoxic, inexpensive, recyclable and environmentally acceptable solvent to remove soils in the dry cleaning process. Effective dry cleaning systems using densified carbon dioxide in combination with selected surfactants are described in U.S. Pat. No. 5,683,977 (Jureller), U.S. Pat. No. 5,667,705 (Jureller); and U.S. Pat. No. 5,683,473 (Jureller). Preferred surfactants described in these patents are combinations of densified carbon dioxide -philic and -phobic functional grorups such as hydrocarbon/halo carbon and polymeric siloxane contianing surfactants.

Applicants have further discovered additional selected surfactants which are both soluble in the densified solvent and effective for removing a variety of stains from a myriad of fabrics.

SUMMARY OF THE INVENTION

It is therefore an object of the present invention to provide additional selected surfactants which are combined with a nonpolar soslvent, such as densified carbon dioxide, to provide a dry cleaning system which effectively removes a variety of soils on fabrics.

Another object of the invention is to provide a dry cleaning system of solvent, surfactant and optionally including a bleach or an enzyme for the total cleaning of fabrics using densified carbon dioxide that gives results equivalent to the cleaning demonstrated by conventional dry cleaning solvents.

In one aspect of the present invention, the dry cleaning used for cleaning a variety of soiled fabrics comprises densified carbon dioxide and about 0.001% to about 5% of a surfactant selected from one of two groups of compounds having the formula:

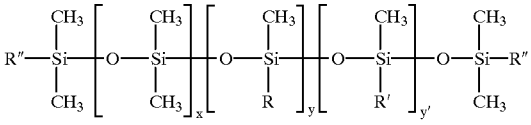

as described or $[AB]_y$ as described.

The surfactant has a densified $CO_2$-philic functional moiety connected to a densified $CO_2$-phobic functional moiety. Preferred $CO_2$-philic moieties of the surfactant include halocarbons such as fluorocarbons, chlorocarbons and mixed fluoro-chlorocarbons, polysiloxanes, and branched polyalkylene oxides. The $CO_2$-phobic groups for the surfactant contain preferably polyalkylene oxides, carboxylates, $C_{1-30}$ alkylene sulfonates, carbohydrates, glycerates, phosphates, sulfates and $C_{1-30}$ hydrocarbons.

The dry cleaning system may also be designed to include a modifier, such as water, or an organic solvent up to only about 10% by volume, a bleaching agent such as a peracid, or an enzyme such as an amylase, protease, lipase or oxidase.

In a second aspect of the invention, a method for dry cleaning a variety of soiled fabrics is provided wherein a selected surfactant and optionally a modifier, bleaching agent, an enzyme or mixtures thereof are combined and the cloth is contacted with the mixture. Densified carbon dioxide is introduced into a cleaning vessel which is then pressurized from about 14.7 psi to about 10,000 psi and the temperature is adjusted to a range of about −78.5° C. to about 100° C. Fresh densified carbon dioxide may be used to flush the cleaning vessel.

DETAILED DESCRIPTION OF PREFERRED EMBODIMENTS

Figure 1:
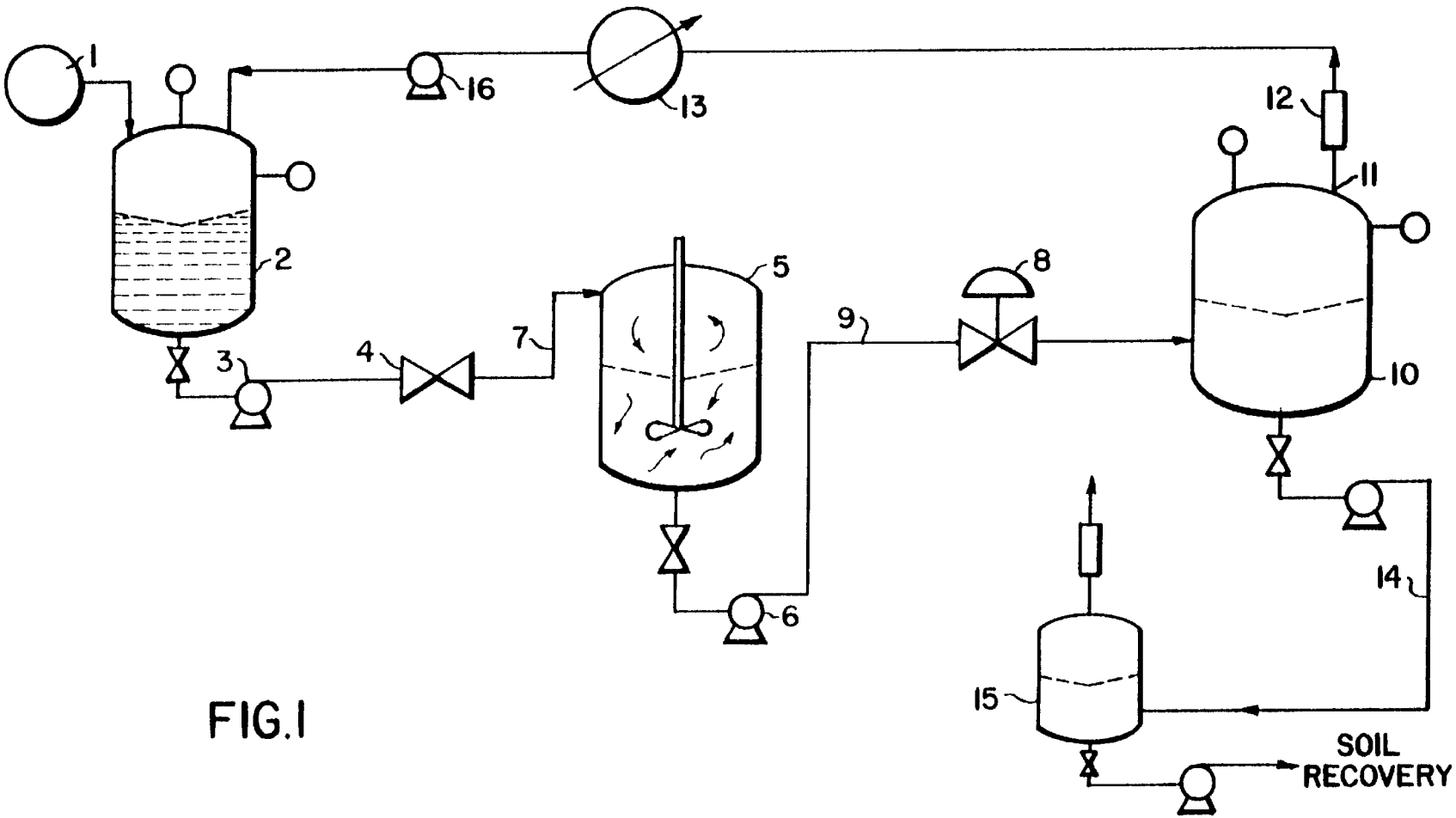
FIG. 1 is a diagrammatic flow chart of the densified carbon dioxide dry cleaning process according to the invention.

The invention provides a dry cleaning system which replaces conventional solvents with densified carbon dioxide in combination with selected cleaning surfactants. Optionally, modifiers, bleaching agents, enzymes and mixtures thereof are combined with the solvent and surfactant to provide a total cleaning system.

For purposes of the invention, the following definitions are used:

"Densified carbon dioxide" means carbon dioxide that has a density (g/ml) greater than that of carbon dioxide gas at 1 atm and 20° C.

"Supercritical fluid carbon dioxide" means carbon dioxide which is at or above the critical temperature of 31° C. and the critical pressure of 71 atmospheres and which cannot be condensed into a liquid phase despite the addition of further pressure.

The term "nonpolar stains" refers to those which are at least partially made by nonpolar organic compounds such as oily soils, sebum and the like.

The term "polar stains" is interchangeable with the term "hydrophilic stains" and refers to stains such as grape juice, coffee and tea.

The term "compound hydrophobic stains" refers to stains such as lipstick and red candle wax.

The term "particulate soils" means soils containing insoluble solid components such as silicates, carbon black, etc.

Densified carbon dioxide, preferably liquid or supercritical fluid carbon dioxide, is used in the inventive dry cleaning system. It is noted that other molecules having densified properties may also be employed alone or in mixture. These molecules include methane, ethane, propane, ammonia, butane, n-pentane, n-hexane, cyclohexane, n-heptane, ethylene, propylene, methanol, ethanol, isopropanol, benzene, toluene, p-xylene, sulfur dioxide, chlorotrifluoromethane, trichlorofluoromethane, perfluoropropane, chlorodifluoromethane, sulfur hexafluoride and nitrous oxide.

During the dry cleaning process, the temperature range is between about −78.5° C. and about 100° C., preferably about 5° C. to about 60° C. and most preferably about 5° C. to about 25° C. The pressure during cleaning is about 14.7 psi to about 10,000 psi, preferably about 75.1 psi to about 7,000 psi and most preferably about 300 psi to about 6,000 psi.

A "substituted methylsiloxyl group" is a methylsiloxyl group substituted with a $CO_2$-phobic group $R^2$ or $R^3$. $R^2$ or $R^3$ are each represented in the following formula:

$$-(CH_2)_a(C_6H_4)_b(A)_d-\{(L)_e(A')_f\}_n-(L')_gZ^2(G)_h$$

wherein a is 1–30, b is 0–1, $C_6H_4$ is substituted or unsubstituted with a $C_{1-10}$ alkylene or alkenylene and A, d, L, e, A', F, n L', g, $Z^2$, G and h are defined below, and mixtures of $R^2$ and $R^3$.

A "substituted arylene" is an arylene substituted with a $C_{1-30}$ alkylene, alkenylene or hydroxyl, preferably a $C_{1-20}$ alkylene or alkenylene.

A "substituted carbohydrate" is a carbohydrate substituted with a $C_{1-10}$ alkylene or alkenylene, preferably a $C_{1-5}$ alkylene.

The terms "polyalkylene oxide", "alkylene" and "alkenylene" each contain a carbon chain which may be either straight or branched unless otherwise stated.

Surfactant Adjuncts

A surfactant which is effective for use in a densified carbon dioxide dry cleaning system requires the combination of densified carbon dioxide-philic funcitonal groups with densified carbon dioxide-phobic functional groups )see definitions above). The resulting compound may form reversed micelles with the $CO_2$-philic functional groups extending into a continuous phase and the $CO_2$-phobic functional groups directed toward the center of the micelle.

The surfactant is present in an amount of from 0.001 to 10 wt. %, preferably 0.01 to 5 wt. %.

The $CO_2$-philic moieties of the surfactants are groups exhibiting low Hildebrand solubility parameters, as described in Grant, D. J. W. et al., "Solubility Behavior of Organic Compounds", Techniques of Chemistry Series, J. Wiley & Sons, N.Y. (1990) pp. 6–55 which describes the Hildebrand solubility equation, herein incorporated by reference. These $CO_2$-philic moieties also exhibit low polarizability and some electron donating capability allowing them to be solubilized easily in densified fluid carbon dioxide.

As defined above, the $CO_2$-philic funcitonal groups are soluble in densified carbon dioxide to greater than 10 wt. %, preferably greater than 15 wt. %, at pressures of 500–10,000 psi and temperatures of 0°–100° C.

Preferred densified $CO_2$-philic funcitonal groups include halocarbons (such as fluoro-, chloro- and fluorochlorocarbons), polysiloxanes and branched polyalkylene oxides.

The $CO_2$-phobic portion of the surfactant molecule is obtained either by a hydrophilic or a hydrophobic functional group which is less than 10 wt. % soluble in densified $CO_2$, preferably less than 5 wt. %, at a pressure of about 14.7 to about 10,000 psi and temperatures about −78.5° C. to about 100° C. Examples of moieties contained in the $CO_2$-phobic groups include polyalkylene oxides, carboxylates, branched acrylate esters, $C_{1-30}$ hydrocarbons, aryls which are unsubstituted or substituted, sulfonates, glycerates, phosphates, sulfates and carbohydrates. Especially preferred $CO_2$-phobic groups include $C_{2-20}$ staight chain or branched alkyls, polyalkylene oxides, glycerates, carboxylates, phosphates, sulfates and carbohydrates.

The $CO_2$-philic and $CO_2$-phobic groups may be directly connected or linked together via a linkage group. Such groups include ester, keto, ether, amide, amine, thio, alkyl, alkenylene, fluoroalkyl, fluoroalkenylene or fluoroalkenylene.

Surfactants which are useful in the invention may be selected from two groups of compounds.

I. First Group

The first group of compounds has the following formula I:

(I)

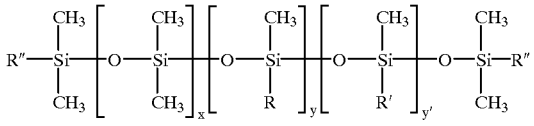

the ratio of x:y and y' is greater than 0.5:1, preferably greater than 0.7:1 and most preferably greater than 1:1, wherein, R, R', R", and R'" are each independently $CH_3$ (with the proviso that they are not all $CH_3$ or have the following formula:

$$-(CH_2)_a(C_6H_4)_b(A)_d-\{(L)_e(A')_f\}_n-(L')_gZ^2(G)_h$$

wherein, a is 1–30, preferably 1–25, most preferably 1–20.

b is 0 or 1, $C_6H_4$ is unsubstituted or substituted with a $C_{1-10}$ alkyl or alkenylene branched or straight chain, and A and A' are each independently a linking moiety representing an ester, a keto, an ether, a thio, an amido, an amino, a $C_{1-4}$ fluoroalkylene, a $C_{1-4}$ fluoroalkenylene, a branched or straight chain polyalkylene oxide, a phosphato, a sulfonyl, a sulfate, an ammonium, a lactam, and mixtures thereof;

d is 0 or 1;

L and L' are each independently a $C_{1-30}$ straight chain or branched alkyl or alkenylene or an aryl which is unsubstituted or substituted and mixtures thereof;

e is 0–3;

f is 0 or 1;

n is 0–10, preferably 0–5, most preferably 0–3;

g is 0–3;

o is 0–5, preferably 0–3;

Z is a hydrogen, a carboxylic acid, a hydroxy, a phosphato, a phosphato ester, a sulfonyl, a sulfonate, a sulfate, a branched or straight-chained polyalkylene oxide, a nitryl, a glyceryl, an aryl unsutstituted or substituted with a $C_{1-30}$ alkylene or alkenylene, (preferably $C_{1-25}$ alkylene), a carbohydrate unsubstituted or substituted with a $C_{1-10}$ alkylene or alkenylene (preferably a $C_{15}$ alkylene) or an ammonium;

G is an anion or cation such as $H^+$, $Na^+$, $Li^+$, $K^+$, $NH_4^+$, $Ca^{+2}$, $Mg^{+2}$, $Cl^{-1}$, $Br^-$, $I^{-1}$, mesylate, or tosylate; and h is 0–3, preferably 0–2, and mixtures of R, R', R", and R'".

Non-limiting examples of this group of surfactants are:

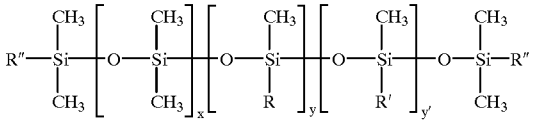

x=1–300, y=1–100, y'=1–100 and R, R', R", or R'"=

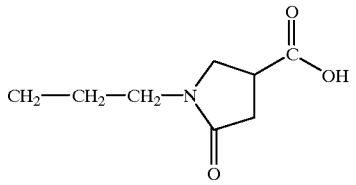

II. Second Group

The second group of compounds, for which Silsoft A-843 and Magnasoft SRS from Witco are commercially available examples, have the following structure II:

$$[AB]_y \quad \text{(II)}$$

wherein,

A is a repeating dimethyl siloxane unit:

(III)

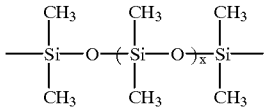

x=0–30,

B is a $CO_2$-phobic group represented by R or R' where R or R' are independently represented by the formula:

$$-(CH_2)_a(C_6H_4)_b(A')_d-\{(L)_e(A'')_f\}_n-(L')_gZ^2(G)_h(C_6H_4)_b-(CH_2)_a$$

wherein, a is 1–30, preferably 1–25; most preferably 1–20, b is 0 or 1, $C_6H_4$ is unsubstituted or substituted with a $C_{1-10}$ alkyl or alkenylene branched or straight, and A' and A" are each independently a linking moiety representing an ester, a keto, an ether, a thio, an amido, an amino, a $C_{1-4}$ fluoroalkyl, a $C_{1-4}$ fluoroalkenylene, a branched or straight chain polyalkylene oxide, a phosphato, a sulfonyl, a sulfate, an ammonium, a lactam, and mixtures thereof;

d is 0 or 1;

L and L' are each independently a $C_{1-30}$ straight chained or branched alkyl or alkenylene or an aryl which is unsubstituted or substituted and mixtures thereof;

e is 0–3;

f is 0 or 1;

n is 0–10, preferably 0–5, most preferably 0–3;

g is 0–3;

o is 0–5, preferably 0–3;

Z is a hydrogen, a carboxylic acid, a hydroxy, a phosphato, a phosphato ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, (preferably $C_{1-25}$ alkyl), a carbohydrate unsubstituted or substituted with a $C_{1-10}$ alkyl or alkenylene (preferably a $C_{1-5}$ alkyl) or an ammonium;

G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate, or tosylate; and h is 0–3; preferably 0–2, y is 2–100 and including mixtures of R and R'.

Nonlimiting examples of this $[AB]_y$ type surfactant are:

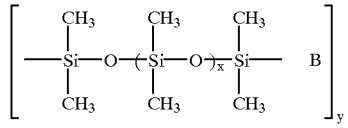

wherein y is 2–100, x is 0–30, and R and R' (i.e. B)=

$$(CH_2)_a(C_2H_4O)_b(C_3H_6O)_c(CH_2)_a$$

$$(CH_2)_aNH(CH_2)_{a'}(C_2H_4O)_b(C_3H_6O)_c(CH_2)_{a'}NH(CH_2)_a$$

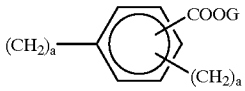

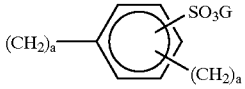

$$(CH_2)_aN(CH_3)_2(CH_2)_{a'}G$$

a=1–30; a'=1–30 b=0–50; c=0–50

G=$H^+$, $Na^+$, $K^+$, $NH_4^+$, $Mg^{+2}$, $Ca^{+2}$, $Cl^-$, $Br^-$, $I^-$, mesylate or tosylate.

Compounds of this type are prepared as described in U.S. Pat. No. 4,150,048, incorporated herein by reference.

Modifiers

In a preferred embodiment, a modifier such as water, or a useful organic solvent may be added to the cleaning drum in a small volume. Water is specifically added into the drum.

Water absorbed onto the fabrics to be drycleaned or present in residual amounts in the surfactant compound from the process of preparing the compounds is not calculated when determining the amount of the modifier which should be added. Preferred amounts of modifier should be 0.1% to about 10% by volume, more preferably 0.1% to about 5% by volume, most preferably 0.1% to about 3%. Preferred solvents include water, acetone, glycols, acetonitrile, $C_{1-10}$ alcohols and $C_{5-15}$ hydrocarbons. Especially preferred solvents include water, ethanol, methanol and hexane.

Peracid Precursors

Organic peracids which are stable in storage and which solubilize in densified carbon dioxide are effective at bleaching stains in the dry cleaning system. The selected organic peracid should be soluble in carbon dioxide to greater than 0.001 wt. % at pressures of about 500 to about 10,000 psi and temperatures of about 0° C. to about 100° C. The peracid compound should be present in an amount of about 0.01% to about 5%, preferably 0.1% to about 3%.

The organic peroxyacids usable in the present invention can contain either one or two peroxy groups and can be either aliphatic or aromatic. When the organic peroxy acid is aliphatic, the unsubstituted acid has the general formula:

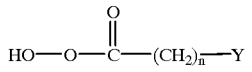

where Y can be, for example, H, $CH_3$, $CH_2Cl$, COOH, or COOOH; and n is an integer from 1 to 20.

When the organic peroxy acid is aromatic, the unsubstituted acid has the general formula:

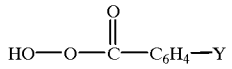

wherein Y is hydrogen, alkylene, alkylenehalogen, halogen, or COOH or COOOH.

Typical monoperoxyacids useful herein include alkylene peroxyacids and arylene peroxyacids such as:

(i) peroxybenzoic acid and ring-substituted peroxybenzoic acid, e.g. peroxy-α-naphthoic acid;

(ii) aliphatic, substituted aliphatic and arylenealkylene monoperoxy acids, e.g. peroxylauric acid, peroxystearic acid, and N,N-phthaloylaminoperoxycaproic acid (PAP); and (iii) amidoperoxy acids, e.g. monononylamide of either peroxysuccinic acid (NAPSA) or of peroxyadipic acid (NAPAA).

Typical diperoxy acids useful herein include alkylene diperoxy acids and arylenediperoxy acids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid; and (ix) N,N'-terephthaloyl-di(6-aminoperoxycaproic acid) (TPCAP).

Particularly preferred peroxy acids include PAP, TPCAP, haloperbenzoic acid and peracetic acid.

Enzymes

Enzymes may additionally be added to the dry cleaning system of the invention to improve stain removal. Such enzymes include proteases (e.g., Alcalase®), Savinase® and Esperase® from Novo Industries A/S; amylases (e.g., Termamyl® and Duramyl® bleach resistant amylases from Novo Industries A/S); lipases (e.g., Lipolase® from Novo Industries A/S); and oxidases. The enzyme should be added to the cleaning drum in an amount from 0.001% to 10%, preferably 0.01% to 5%. The type of soil dictates the choice of enzyme used in the system. The enzymes should be delivered in a conventional manner, such as by preparing an enzyme solution, typically of 1% by volume (i.e., 3 mls enzyme in buffered water or solvent).

Dry Cleaning Process

A process of dry cleaning using densified carbon dioxide as the cleaning fluid is schematically represented in FIG. 1. A cleaning vessel 5, preferably a rotatable drum, receives soiled fabrics as well as the selected surfactant, and any modifier, peracid and mixtures thereof. The cleaning vessel may also be referred to as an autoclave, particularly as described in the examples below.

Densified carbon dioxide is introduced into the cleaning vessel from a storage vessel 1. Since much of the $CO_2$ cleaning fluid is recycled within the system, any losses during the dry cleaning process are made up through a $CO_2$ supply vessel 2. The $CO_2$ fluid is pumped into the cleaning vessel by a pump 3 at pressures ranging between about 14.7 and about 10,000 psi, preferably about 300 to about 7000 psi, most preferably about 800 psi to about 6000 psi. The $CO_2$ fluid is maintained at temperatures of about −78.5° C. to about 100° C., preferably about 50° C. to about 60° C., most preferably about 5° C. to about 60° C. by a heat exchanger 4, or by pumping a cooling solution through an internal condenser.

As an example of the operation of the system, the densified $CO_2$ is transferred from the supply vessel 2 to the cleaning vessel 5 through line 7 for a dry cleaning cycle of between about 15 to about 30 minutes. Before or during the cleaning cycle, surfactants, modifiers, enzymes, peracid and mixtures thereof as discussed above are introduced into the cleaning vessel, preferably through a line and pump system connected to the cleaning vessel.

At the end of the dry cleaning cycle, dirty $CO_2$, soil and spent cleaning agents are transferred through an expansion valve 6, a heat exchanger 8 by way of a line 9 into a flash drum 10. In the flash drum, pressures are reduced to between about 260 and about 1,000 psi and to a temperature of about 23° C. to about 60° C. Gaseous $CO_2$ is separated from the soil and spent agents and transferred via line 11 through a filter 12 and condenser 13 to be recycled back to the supply vessel 2. Any pressure losses are recovered by using pump 16. The spent agents and residue $CO_2$ are transferred via line 14 to an atmospheric tank 15, where the remaining $CO_2$ is vented to the atmosphere.

Other processes known in the art may be used in the claimed dry cleaning system such as those described in Dewees et al., U.S. Pat. No. 5,267,455, owned by The Clorox Company and JP 08052297 owned by Hughes Aircraft Co., herein incorporated by reference.

The following examples will more fully illustrate the embodiments of the invention. All parts, percentages and proportions referred to herein and in appended claims are by weight unless otherwise indicated. The definitions and examples are intended to illustrate and not limit the scope of the invention.

Example 1

The hydrophilic stain, grape juice, was dry cleaned using liquid carbon dioxide, a polydimethylsiloxane surfactant, water as a modifier and mixtures thereof according to the invention.

Two inch by three inch polyester cloths were cut and soaked in concentrated grape juice which was diluted 1:4 with water. The cloths were then removed and dried overnight on plastic sheets. The stained fabrics were then placed in a 300 ml autoclave having a gas compressor and an extraction system as shown in FIG. 1. The stained cloth was hung from the bottom of the autoclave's overhead stirrer using a copper wire to promote good agitation during washing and extraction. After placing the cloth in the autoclave and sealing it, liquid $CO_2$ at a tank pressure of 850 psi was allowed into the system and was cooled to reach a temperature of about 11° C. at which point the liquid $CO_2$ was at a pressure of about 800 psi. The stirrer was then turned on for 15 minutes to mimic a wash cycle. At the completion of the wash cycle, 20 cubic feet of fresh $CO_2$ were passed through the system to mimic a rinse cycle. The pressure of the autoclave was then released to atmospheric pressure and the cleaned cloths were removed from the autoclave. To measure the extent of cleaning, spetrophotometric readings were taken using a Hunter Ultrasacn XE® spectrophotometer. The R scale, which measures darkness from black to white, was used to determine stain removal. Cleaning results were reported as the percent stain removal according to the following calculation:

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100\%$$

Two different polydimethylsiloxane surfactants were used alone or in combination with 0.5 ml of water and liquid carbon dioxide. The control was liquid carbon dioxide alone.

The water was added directly to the bottom of the autoclave and not on the stain itself and the surfactant was applied directly to the stain on the cloth. After the wash and rinse cycles, cleaning results were evaluated and the results are reported in Table 1 below.

TABLE 1

Dry Cleaning Results on Grape Juice Stains Using Supercritical Carbon Dioxide and Polydimethylsiloxane Surfactant

| Stain | Cloth | Surfactant | Modifier | % Stain Removal |
|---|---|---|---|---|
| grape juice | Polyester | None | None | 2.5 |
| grape juice | Polyester | None | 0.5 ml water | 0.3 |
| grape juice | Polyester | 0.67 g Silsoft A-843[1] | 0.5 ml water | 13.6 |
| grape juice | Polyester | 0.2 g Monasil PCA[2] | 0.5 ml water | 19.0 |

[1]Supplied by Witco; $[AB]_y$ silicone copolymer.
[2]Supplied by Mona Industries; lactam modified silicone copolymer.

It was observed that the combination of water as a modifier with the selected silicone surfactants improved dry cleaning results in liquid carbon dioxide. Liquid carbon dioxide alone or with water added did not appreciably clean the stain.

Example 2

The hydrophilic stain, grape juice, was dry cleaned using liquid carbon dioxide, and mixtures of liquid carbon dioxide, polydimethylsiloxane surfactant, and water according to the invention.

8.75"×4.75" cloths had a 2" diameter circle inscribed in pencil in the middle and concentrated grape juice which was diluted 1:4 with water was applied using a micropipet to the inside of the circles and spread to the edges of the circle. The following amounts were used: on polyester and wool, 475 microliters; on cotton 350 microliters; and on silk, 2 applications of 200 microliters with 15 minutes in between applications. The cloths were then dried overnight. Four replicates of each cloth type (for a total of 12 cloths) were placed in the cleaning chamber of a $CO_2$ dry cleaning unit constructed as taught in U.S. Pat. No. 5,467,492 and employing hydrodynamic agitation of garments by use of appropriately angled nozzles. To simulate a full load of clothes, 1.5 pounds of cotton ballast sheets (11"×11") were also placed in the cleaning chamber. The dry cleaning unit employed had a cleaning chamber which holds about 76 liters of liquid $CO_2$. The piping in the cleaning loop held an additional 37 liters for a total volume in the cleaning loop of 113 liters. There was also a storage tank on the unit from which the fresh liquid $CO_2$ was added once the chamber door was closed and sealed. The cleaning cycle lasted for 15 minutes at about 850 psi and 11 degrees Celsius. After the cleaning cycle, the liquid $CO_2$ in the cleaning loop was pumped back into the storage tank, and the chamber door opened. To measure the extent of cleaning, spectrophotometric readings were taken on the washed grape juice cloths using a Hunter Ultrascan XE[7] spectrophotometer. The L,a,b scale was used to measure cleaning. Cleaning results were reported as stain removal index values (SRI's) using the following calculation:

$$SRI = 100 - \sqrt{(L_{washed} - L_{clean})^2 + (a_{washed} - a_{clean})^2 + (b_{washed} - b_{clean})^2}$$

where,

L measures black to white differences, a measures green to red differences and, b measures blue to yellow differences.

Two experiments were run—concentrations are in weight/volume of $CO_2$:

1. no additive (liquid $CO_2$ alone)
2. 0.05% Monasil PCA+0.075% water

Surfactant and water were premixed and added directly to the bottom of the cleaning chamber below the ballast and not on the stains themselves. After the wash cycle removal of $CO_2$ from the cleaning chamber, cleaning results were evaluated, and are reported in Table 2 below.

TABLE 2

| Stain | Fabric | Experiment Number | Stain Removal Index |
|---|---|---|---|
| grape juice | wool (LSD* = 4.90) | 2 | 72.90 |
| | | 1 | 65.06 |
| | polyester (LSD = 3.51) | 2 | 71.63 |
| | | 1 | 61.41 |
| | cotton (LSD = 1.03) | 2 | 63.45 |
| | | 1 | 61.35 |

*LSD stands for the "least significant difference" and the numbers shown are at the 95% confidence level.

It was observed that for all three cloth types studied, addition of Monasil PCA plus water improved the dry cleaning results in liquid dioxide.

We claim:

1. A dry cleaning system for removing stains from fabrics comprising:

(a) an effective amount of densified carbon dioxide;

(b) 0.001% to 10% by weight of a surfactant having the formula $$[AB]_y \qquad \text{(II)}$$

wherein A is a repeating dimethyl siloxane unit:

(III)

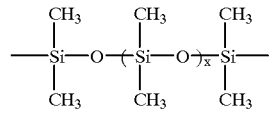

x=0–30;

B is a $CO_2$-phobic group represented by $$-(CH_2)_e(C_6H_4)_b(A')_d-\{(L)_a(A'')_f\}_n-(L')_gZ^2(G)_h(C_6H_4)_b(CH_2)_a$$

wherein, a is 1–30, b is 0 or 1, $C_6H_4$ is unsubstituted or substituted with a $C_{1-10}$ alkylene or alkenylene branched or straight and A' and A" are each independently a linking moiety representing an ester, a keto, an ether, a thio, an amido, an amino, a $C_{1-4}$ fluoroalkylene, a $C_{1-4}$ fluoroalkenylene, a branched or straight chain polyalkylene oxide, a phosphato, a sulfonyl, a sulfate, an ammonium, a lactam, and mixtures thereof, d is 0 or 1, L and L' are each independently a $C_{1-30}$ straight chained or branched alkylene or alkenylene or an aryl which is unsubstituted or substituted and mixtures thereof, e is 0–3, f is 0 or 1, n is 0–10, g is 0–3, o is 0–5, $Z^2$ is a hydrogen, a carboxylic acid, a hydroxy, a phosphato, a phosphato ester, a sulfonyl, a sulfonate, a sulfate, a branched or straight-chained polyalkylene oxide, a nitryl, a glyceryl, an aryl unsubstituted or substituted with a $C_{1-30}$ alkylene or alkenylene, a carbohydrate unsubstituted or substituted with a $C_{1-10}$ alkylene or alkenylene or an ammonium;

G is an anion or cation selected from $H^+$, $Na^+$, $Li^+$, $K^+$, $NH_4^+$, $Ca^{+2}$, $Mg^{+2}$, $Cl^-$, $Br^-$, $I^-$, mesylate, or tosylate, h is 0–3, y is 2–100 wherein A is terminated with hydrogen and B is terminated with an allyl group.

2. The system according to claim 1 wherein the compounds of formula II are those wherein y is 2 to 100, x is 0 to 30 and B is selected from the group consisting of:

$(CH_2)_a(C_2H_4O)_b(C_3H_6O)_c(CH_2)_a$ $(CH_2)_aNH(CH_2)_{a'}(C_2H_4O)_b(C_3H_6O)_c(CH_2)_{a'}NH(CH_2)_a$

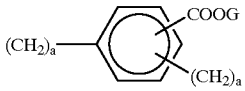

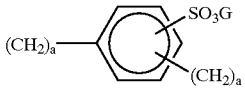

or $(CH_2)_aN(CH_3)_2(CH_2)_{a'}G$ a=1–30; a'=1–30 b=0–50; c=0–50

G=$H^+$, $Na^+$, $K^+$, $NH_4^+$, $Mg^{+2}$, $Ca^{+2}$, $Cl^-$, $Br^-$, $I^-$, mesylate or tosylate.

3. The sytem according to claim 1 further comprising 0.1% to about 10% by volume of a modifier selected from the group consisting of water, acetone, a glycol, acetonitrile, $C_{1-10}$ alcohol and $C_{5-15}$ hydrocarbon.

4. The sytem according to claim 1 wherein the densified carbon dioxide is in a liquid phase having a pressure of about 14.7 psi to about 10,000 psi and a temperature of about −78.5° C. to about 100C.

5. The system according to claim 1 wherein the system further comprises an organic peracid selected from the group consisting of N,N-phthaloylaminoperoxycaproic acid (PAP) and N,N'-terephthaloyl-di(6-aminoperoxycaproic acid (TPCAP), a haloperbenzoic acid and peracetic acid.

* * * * *